United States Patent [19]

Kulpa

[11] 4,136,705

[45] Jan. 30, 1979

[54] HAIR ROLLER

[75] Inventor: Walter J. Kulpa, Norwalk, Conn.

[73] Assignee: Sperry Rand Corporation, Bridgeport, Conn.

[21] Appl. No.: 741,919

[22] Filed: Nov. 15, 1976

[51] Int. Cl.[2] ..... A45D 2/00

[52] U.S. Cl. ..... 132/40; 229/41 B

[58] Field of Search ..... 132/40, 42, 7, 39, 43 R, 132/37 A, 34; 206/41 B, 93

[56] References Cited

U.S. PATENT DOCUMENTS

| | | | |
|---|---|---|---|
| 1,545,771 | 7/1925 | Hout | 229/41 B |
| 2,226,178 | 12/1940 | Page | 229/41 B |
| 2,283,406 | 5/1942 | Bacon | 229/41 R |
| 2,369,385 | 2/1945 | Carruth et al. | 229/41 B |
| 2,402,944 | 7/1946 | Braloff | 229/41 B |
| 2,889,834 | 6/1959 | Anderson et al. | 132/7 |
| 3,108,603 | 10/1963 | Mobberley | 132/34 |
| 3,232,300 | 2/1966 | Fisher | 132/39 |
| 3,404,694 | 10/1968 | Hammel | 132/40 |

*Primary Examiner*—G. E. McNeill
*Attorney, Agent, or Firm*—Charles R. Miranda

[57] ABSTRACT

A hair roller is described having first and second flexible, generally planar roller members which are hinge coupled and are deflectable from a generally planar configuration into a body having a generally cylindrically shaped configuration. Edge segments of the members are preformed to have arcuate cross sectional configurations for causing the hair roller body to conform to a circular cross sectional configuration.

4 Claims, 9 Drawing Figures

14
26
55
30
24

60
64
68
66
62
63

76
59
60
63
72
80
74
70
62
68
64
82
66
78

59
60
10
63
70
74
64
62
66

46
14
42
44
34
38
26
54
50
52
48
20
22
28
36
12
16
24
18
10
40

14
22
24
30
18
28
32
12
16

108
90
104
95
98
100
92
94
96
102
106

92
95
104
98
96
94
102
90

14
50
54
48
52
55
34
36
10
12
28
55
44

HAIR ROLLER

BACKGROUND OF THE INVENTION

This invention relates to hair rollers and, more particularly, to an improved form of cylindrically shaped hair roller which may be stored flat.

The use of rollers for the styling and setting of hair is well known. In one arrangement, a hair roller body which is generally cylindrically shaped is provided and a person's hair is wound about and secured to the roller body. The hair thus formed on the roller body can be warmed to enhance setting. Alternatively, the hair remains wound about the curling body for an extended period of time to achieve setting under ambient air conditions.

The use of hair rollers is facilitated when the cylindrically shaped roller body is substantially resistant to bending and buckling. It is also desirable for purposes of packaging by the manufacturer and storage by the user to provide a roller of this type which can be stored in a substantially flat configuration.

In a copending U.S. patent application Ser. No. 741,611 which is filed concurrently herewith and which is assigned to the assignee of this invention, a hair roller of the type described is disclosed and is formed of two, flexible, generally planar shaped roller members which are mechanically intercoupled by a hinging means. In one arrangement, both longitudinally extending edges of one roller member are hinge coupled to a surface of the other roller member. In another disclosed arrangement, one edge of each roller member is hinge coupled to a surface of the other roller member. In another arrangement, the roller members are hinge coupled along their edges.

These hair roller arrangements are adapted to be stored in a generally flat configuration and to be expanded into a body having a generally cylindrically shaped configuration. While the body is generally cylindrically shaped, it is found that, at times, the body departs from a circular cross section of the generally cylindrical configuration. This departure occurs along the circumference in the hinged area. In hinge coupling between an edge and a surface of opposite members, an overlapping and doupling up of the circumferential thickness of the body wall exists for a portion of the circumference and this doubling up introduces a stiffness in the body which resists conformity to the desired circular cross section. In the case where edge segments of each member are hinged, a discontinuity in the circular cross sectional configuration exists at the hinge joint. Hair roller users prefer to use a circular cross sectional body and these departures from a circular cross section are therefore undesirable.

Accordingly, it is an object of this invention to provide an improved hair roller of the type described having first and second roller members which are hinged coupled and which exhibit a substantially circular cross sectional configuration.

Another object of the invention is to provide a hair roller of the type described having means for reducing departures of the hair roller from a circular arc in the area of a hinged coupling.

SUMMARY OF THE INVENTION

In accordance with features of this invention, a hair roller comprises first and second, flexible, generally planar roller members each having longitudinally extending edges. Means are provided for hinge coupling the roller members whereby surfaces of the roller members are positioned in juxtaposed relationship and said coupled roller members are resiliently deflectable from a generally planar configuration into a body having generally cylindrically shaped configuration. The generally planar shaped roller members include longitudinally extending, edge segments having an arc shaped cross sectional configuration for providing that contact between an edge segment and the other roller member causes deflection of the members at the hinge into a circular arc. Fastening means are provided for maintaining the body in a deflected cylindrically shaped configuration.

BRIEF DESCRIPTION OF THE DRAWINGS

These and other objects and features of the invention will become apparent with reference to the following specification and to the drawings wherein.

DETAILED DESCRIPTION

Figures 1, 2, 3, 4, 5, 6, 7, 8, 9:
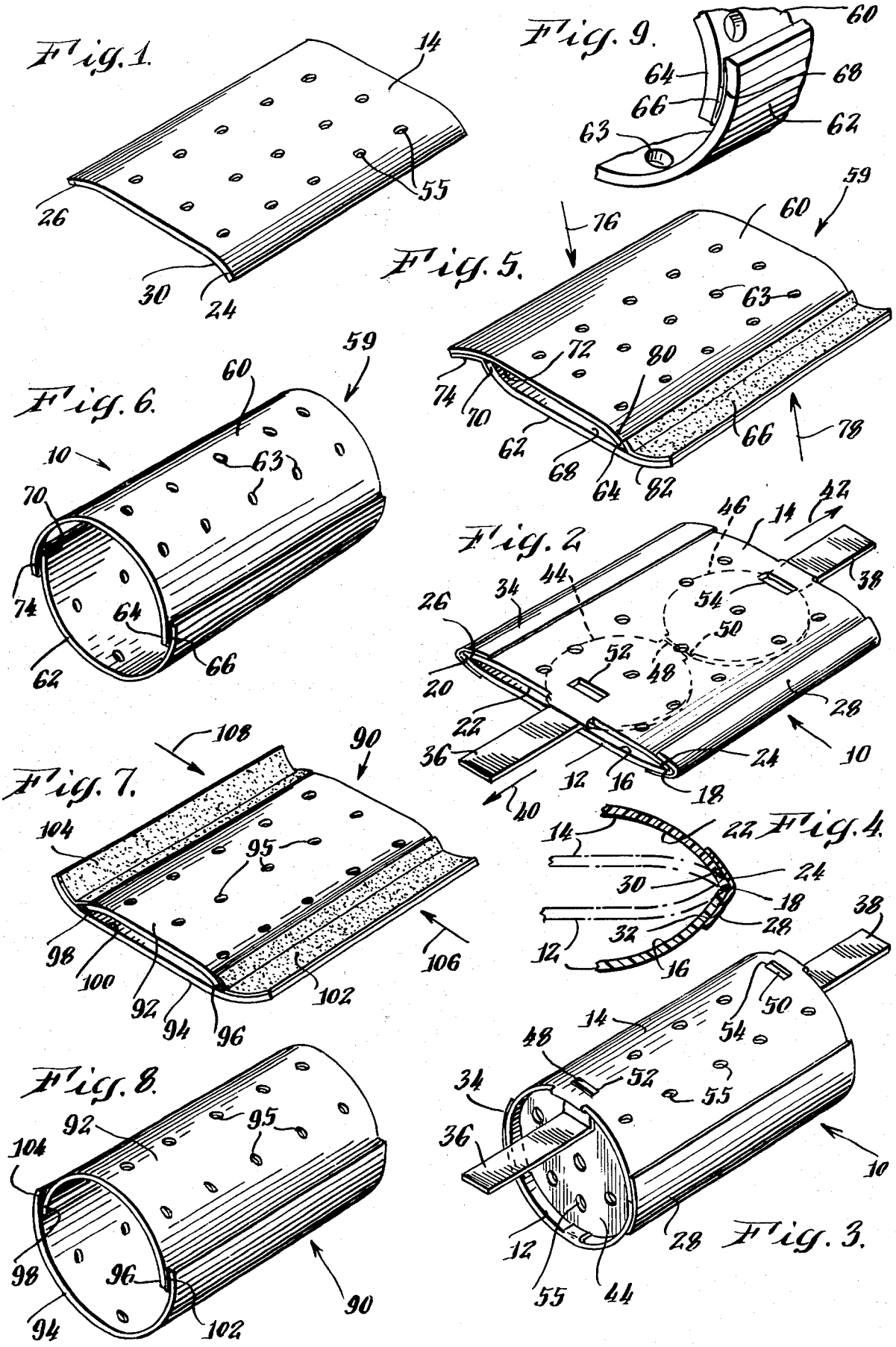
FIG. 1 is a perspective view of a hair roller member having edge segments thereof preformed in accordance with an embodiment of the invention.
FIG. 2 is a perspective view of one form of a hair roller in an undeflected planar configuration and constructed in accordance with features of the invention.
FIG. 3 is a perspective view of the hair roller of FIG. 2 illustrating the hair roller expanded into a body having a generally cylindrically shaped configuration.
FIG. 4 is a fragmentary, enlarged view of a hinge coupling of FIGS. 2 and 3.
FIG. 5 is a perspective view of another form of hair roller constructed in accordance with features of the invention.
FIG. 6 is a perspective view of the hair roller of FIG. 5 expanded into a body having a generally cylindrically shaped configuration.
FIG. 7 is a perspective view of another form of hair roller constructed in accordance with features of this invention.
FIG. 8 is a perspective view of the hair roller of FIG. 6 expanded into a body having a generally cylindrically shaped configuration; and, FIG. 9 is a fragmentary, enlarged view of a hinge coupling of FIG. 6.

Referring now to the drawings and particularly to FIGS. 1–4, a hair roller 10 is provided which is adapted to be expanded from a substantially flat configuration as illustrated in FIG. 2 into an elongated, generally cylindrically shaped body, as illustrated in FIG. 3, which is substantially resistant to bending and buckling. The hair roller 10 (FIG. 2) is formed by first and second generally planar shaped flexible roller members 12 and 14 respectively. The roller member 12 has a surface 16 and longitudinally extending edges 18 and 20. The edge 18 is illustrated in greater detail in FIG. 4. Similarly the roller member 14 has a surface 22 and first and second longitudinally extending edges 24 and 26.

A means for hinge coupling the roller members 12 and 14 enables their surfaces 16 and 22 respectively to be positioned in juxtaposed relationship, as illustrated in FIG. 2, and the members 12 and 14 to be resiliently deflected from the generally planar shaped configuration of FIG. 2 into the generally cylindrically shaped body of FIG. 3. The hinge coupling means comprises a first elongated adhesive strip 28 which contacts and adheres to elongated edge segments 30 and 32, (FIG. 4).

A second elongated adhesive strip 34 is also provided and is positioned for adhering to similar edge segments of the members 12 and 14 adjacent the edges 20 and 26 respectively. Alternatively, the strips 28 and 34 may be heat sealed to the edge segments.

Deflection of the hair roller 10 from the generally planar configuration of FIG. 2 into a body having the generally cylindrical shaped configuration of FIG. 3 is accomplished by drawing grip tabs 36 and 38 in the direction indicated by the arrows 40 and 42 (FIG. 2) respectively. These grip tabs are coupled to hinged fastener members 44 and 46 respectively and cause the fastener members to rotate, contact surfaces 16 and 22 of the roller members and force them apart, thereby deflecting the members into the cylindrically shaped body of FIG. 3. A fastener means comprising the fastener members 44 and 46, tabs 48 and 50 which are integrally formed with the members 44 and 46, and slots 52 and 54 formed in the roller member 14 maintain the body in a cylindrically shaped configuration. Upon rotation of the fastener members 44 and 46, the tabs 48 and 50 are received and engage the slots 52 and 54 respectively.

The roller members 12 and 14 are formed of a material and have a thickness for providing that the hair roller is resiliently deflectable. As the fastener members 44 and 46 rotate and contact the surfaces 16 and 22, the roller members will resiliently deflect into semicircular curved surfaces defining the cylindrical body of FIG. 3. By disengaging the tabs 48 and 50 from the slots 52 and 54 respectively, the shape of the roller members will be restored from the semicircular configuration of FIG. 3 to the generally planar configuration of FIG. 2. A plurality of perforations 55 are formed in the roller members 12 and 14 and in the fastener members 44 and 46 for enhancing air flow through the roller and the application of hair treatment materials to hair wound on the roller.

The roller members 14 and 16 are formed of a material and have a thickness for providing the desired resilient characteristics. While various materials can be employed, in one arrangement the roller members 12 and 14 are fabricated from a sheet of polymer plastic such as polypropylene having a thickness in the range of about 0.010 inches to 0.015 inches (0.025 cm to 0.038 cm).

Hinge coupled edges 18 and 24 can form a discontinuity in the circumference of the cylindrical body and because of forces exerted at these edges, the shape of the body can depart from a circular arc in the area of the hinge and at times can flex outwardly. In accordance with a feature of the invention, the edge segments 30 and 32, adjacent edges 24 and 18 respectively and edge segments adjacent edges 20 and 26 are preformed to provide an arcuate cross section, as is illustrated in FIG. 4 and in FIG. 1, with respect to the roller member 14. Preforming is accomplished, for example, with a polymer material by heat setting. Other materials may be mechanically preformed. It will be noted from FIG. 4 that relative positioning of the members 12 and 14 provides that the arcuate curvatures of the hinged edge segments 30 and 32 extend in opposite directions, and establish opposing forces upon deflection of the members 12 and 14. These forces will resist outward deflection of the edges as the members 12 and 14 are deflected into the body of FIG. 3 and operate to conform the area of the hinge to a circular arc. In the orientation of members in FIG. 4, the edge segment 30 has a generally clockwise curvature while the edge segment 32 has an opposing, clockwise curvature. The radius of arcuate curvature of an edge segment and the length of arc are selected in accordance with the diameter of the hair roller 10, the roller member material and its thickness in order to oppose an outward deflection and to provide circular conformity.

The features of the invention are also utilized on other forms of hinged coupled hair rollers. FIG. 5 illustrates a hair roller 59 having hair roller members 60 and 62 including a plurality of air flow and hair treatment apertures 63 and wherein a longitudinally extending edge 64 of the member 60 is hinged coupled by an adhesive strip 66 to a surface 68 of the member 62. Similarly, an elongated edge 70 of the member 62 is hinged coupled to a surface 72 of the member 60 by an elongated strip 74. The application of a finger force in the direction of the arrows 76 and 78 to an upper surface of the roller member 60 and to a lower surface of the roller member 62 causes deflection of the members into a body having a cylindrically shaped configuration as illustrated in FIG. 6. The body is fastened in this configuration by providing adhesive strips 74 and 66 which are double sided adhesive strips. In FIG. 6, the hinge coupling is exaggerated and enlarged with respect to the remainder of the cylindrically shaped body in order to more clearly illustrate the coupling. FIG. 9 is an enlarged view of the hinge coupling.

Edge segments 80 and 82 of the roller members 60 and 62 are formed into arcuate cross sectional configurations for conforming the cross section of the body of FIG. 6 to a circular configuration. Overlapped areas exhibit substantially greater stiffness than non-overlapped areas and do not bend as readily as non-overlapped areas to form the circular cross sectional configuration desired. By preforming the edge segments, the edges are forced to flex in opposite directions when a roller forming force is exerted during deflection of the roller members.

Another form of hinge coupled hair roller 90 is illustrated in FIG. 7. In this arrangement, a first roller member 92 has dimensions smaller than the second roller member 94. The members 92 and 94, have air flow and hair treatment apertures 95. Longitudinally extending edges 96 and 98 of the member 92, are hinged coupled to a surface 100 of the member 94 by adhesive strips 102 and 104 respectively. Application of finger force in the direction of the arrows 106 and 108 causes the members to deflect into the cylindrically shaped body of FIG. 8. The hinges of FIG. 8 are exaggerated in size with respect to the remainder of the body in order to illustrate the hinge configuration. Edge segments of each of the members 92 and 94 are preformed to have arcuate cross sectional configurations in order to provide, as indicated above, conformity of the cross sectional configuration of the cylindrical body of FIG. 8 to a circular cross section.

A strip of release paper, which for purposes of clarity in the drawings is not illustrated, is positioned on the upper or exposed adhesive surface of each of the strips 60 and 66 of the hair roller of FIG. 5 and 102 and 104 of the hair roller of FIG. 7 and inhibits the flattened hair roller from adhering to other hair rollers or objects when stacked or stored.

An improved hair roller has been described having flexible, generally planar hair roller members which are hinge coupled for deflection into a generally cylindrically shaped body and which include preformed edge segments. The preformed edge segments have arcuate cross sectional configurations which cause the formed hair roller to exhibit a circular cross sectional configuration.

While particular embodiments of the invention have been described, it will be apparent to those skilled in the art that variations may be made thereto without departing from the spirit of the invention and the scope of the appended claims.

What is claimed is:

1. An improved hair roller comprising in combination, a pair of resiliently flexible rectangular shaped elongated substantially flat roller members each having a pair of opposed elongated marginal segments terminating in longitudinal edges, said roller members arranged in overlying relationship to each other with said marginal segments arranged in adjacent parallel pairs extending in the longitudinal direction, means attached to each of said adjacent pairs of said marginal segments in bridging relationship to at least one of said longitudinal edges of said pairs of marginal segments for hinge coupling one of said roller members to the other of said roller members, said hinge-coupled members being resiliently deflectable from said overlying relationship to an arcuate shaped spaced apart relationship to form a generally hollow cylindrical shaped roller body, means attached to at least one of said roller members for releasably maintaining said roller body in said cylindrical shaped configuration, said roller body being substantially resistant to bending and buckling from externally applied finger force and the resiliency of said roller members urging said roller body into a substantially flat configuration upon release of said maintaining means, the improvement comprising in that said marginal segments each having a preformed arc shaped transverse cross sectional configuration for conforming the surface of the marginal segments to the circular arc of said cylindrical shaped configuration of the roller body upon deflecting said hinge-coupled roller members into said roller body.

2. The improved hair roller of claim 1 wherein the arc-shaped marginal segments of a first of said roller members are formed in an opposite direction with respect to the arc-shaped curvature of the marginal segments of a second of said roller members to oppose outward deflection of the roller members and provide said circular conformity.

3. The improved hair roller of claim 2 wherein said hinge coupling is provided by the marginal segments of said first member having edge portions hinge-coupled to surface portions of the marginal segments of said second member.

4. The improved hair roller of claim 2 wherein said hinge coupling is provided by one of the marginal segments of said first member having an edge portion hinge-coupled to the surface portion of the marginal segment of said second member and the other marginal segment of said second member having an edge portion hinge coupled to a surface portion of the other marginal segment of said first member.

* * * * *